US007338458B2

(12) United States Patent
Hsien

(10) Patent No.: US 7,338,458 B2
(45) Date of Patent: Mar. 4, 2008

(54) AIR-PRESSURE MASSAGING DEVICE HAVING AN AUTOMATIC ADJUSTMENT FUNCTION

(76) Inventor: Wen-Hsu Hsien, No. 27, Lane 300, Tien Shiang Road, Chang Hua City (TW)

( * ) Notice: Subject to any disclaimer, the term of this patent is extended or adjusted under 35 U.S.C. 154(b) by 471 days.

(21) Appl. No.: 11/031,600

(22) Filed: Jan. 6, 2005

(65) Prior Publication Data

US 2006/0149173 A1 Jul. 6, 2006

(51) Int. Cl.
*A61H 7/00* (2006.01)
*A61H 19/00* (2006.01)

(52) U.S. Cl. ..... 601/90; 601/84; 601/86; 601/93; 601/94

(58) Field of Classification Search ..... 601/84–90, 601/93, 94, 96, 101–103, 126, 136, 133–134
See application file for complete search history.

(56) References Cited

U.S. PATENT DOCUMENTS 6,517,500 B2 * 2/2003 Ichikawa ..... 601/98
2005/0033204 A1 * 2/2005 Nakamura et al. ..... 601/103
2006/0142676 A1 * 6/2006 Fujii et al. ..... 601/98
2006/0217643 A1 * 9/2006 Yonekawa et al. ..... 601/148

* cited by examiner

*Primary Examiner*—Justine R. Yu
*Assistant Examiner*—Kristen C. Matter
(74) *Attorney, Agent, or Firm*—Charles E. Baxley

(57) ABSTRACT

An air-pressure massaging device having an automatic adjustment function comprises: a base, inside which being disposed a drive rod; two fixed massaging assemblies mounted onto the drive rod; two adjustable massaging assemblies moveably mounted onto the drive rod; an airbag disposed in the base serving to move the adjustable massaging assembly relative to the fixed massaging assembly. Through inflation and deflation of the airbag, the adjustable massaging assemblies will be caused to move relative to the fixed massaging assemblies, so that a distance between the fixed massaging assemblies and the adjustable massaging assemblies is adjusted.

26 Claims, 16 Drawing Sheets

AIR-PRESSURE MASSAGING DEVICE HAVING AN AUTOMATIC ADJUSTMENT FUNCTION

BACKGROUND OF THE INVENTION

1. Field of the Invention

The present invention relates to a massaging device, and more particularly to an air-pressure massaging device having an automatic adjustment function.

2. Description of the Prior Arts

Normally, a massaging device for massaging the leg, foot or hand comprises a pair of oppositely arranged massaging structures, and the part to be massaged is placed between the massaging structures, and then the massaging structures will oscillate to provide a massage effect. However, the distance between the massaging structures is adjustable to fit different user's legs, thus it is unable to provide a suitable massaging force and a comfortable massaging effect.

JP Patent No. 2002-153532, as shown in FIGS. 1 and 2, uses screw bolt to adjust the distance between the massaging structures so as to fit different user's legs, in which a pair of massaging assemblies 11 are mounted on a drive rod 10. An adjusting rod 12 is inserted in the drive rod 10, at both sides of the adjusting rod 12 are provided threads 13 for controlling the distance between the two massaging assemblies 11. In each of the massaging assemblies 11 is disposed an inner massaging assembly 14. However, the disadvantages of this massaging device is that the massaging assemblies 11 are moved by the threads 13 of the adjusting rod 12, after the adjusting rod 12 is adjusted, the position of the massaging assembly 11 relative to the adjusting rod 12 is fixed, the massaging assembly 11 will apply force to the part of the user to be massaged. Hence, it lacks elasticity between the massaging assembly 11 and the part to be massaged, thus the user will feel uncomfortable.

The present invention has arisen to mitigate and/or obviate the afore-described disadvantages.

SUMMARY OF THE INVENTION

The primary objective of the present invention is to provide an air-pressure massaging device capable of adjusting the distance between the adjustable massaging assembly and the fixed assembly can be adjusted through the inflation and deflation of an airbag, and accordingly the massaging force is properly adjusted.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Referring to FIGS. 3-9 and 14, an air-pressure massaging device having an automatic adjustment function in accordance with a preferred embodiment of the present invention is shown and comprises a base 20, two fixed massaging assemblies 30, two adjustable massaging assemblies 40A and 40B, two massaging wheel assemblies 50 and an airbag 60.

Figure 9:
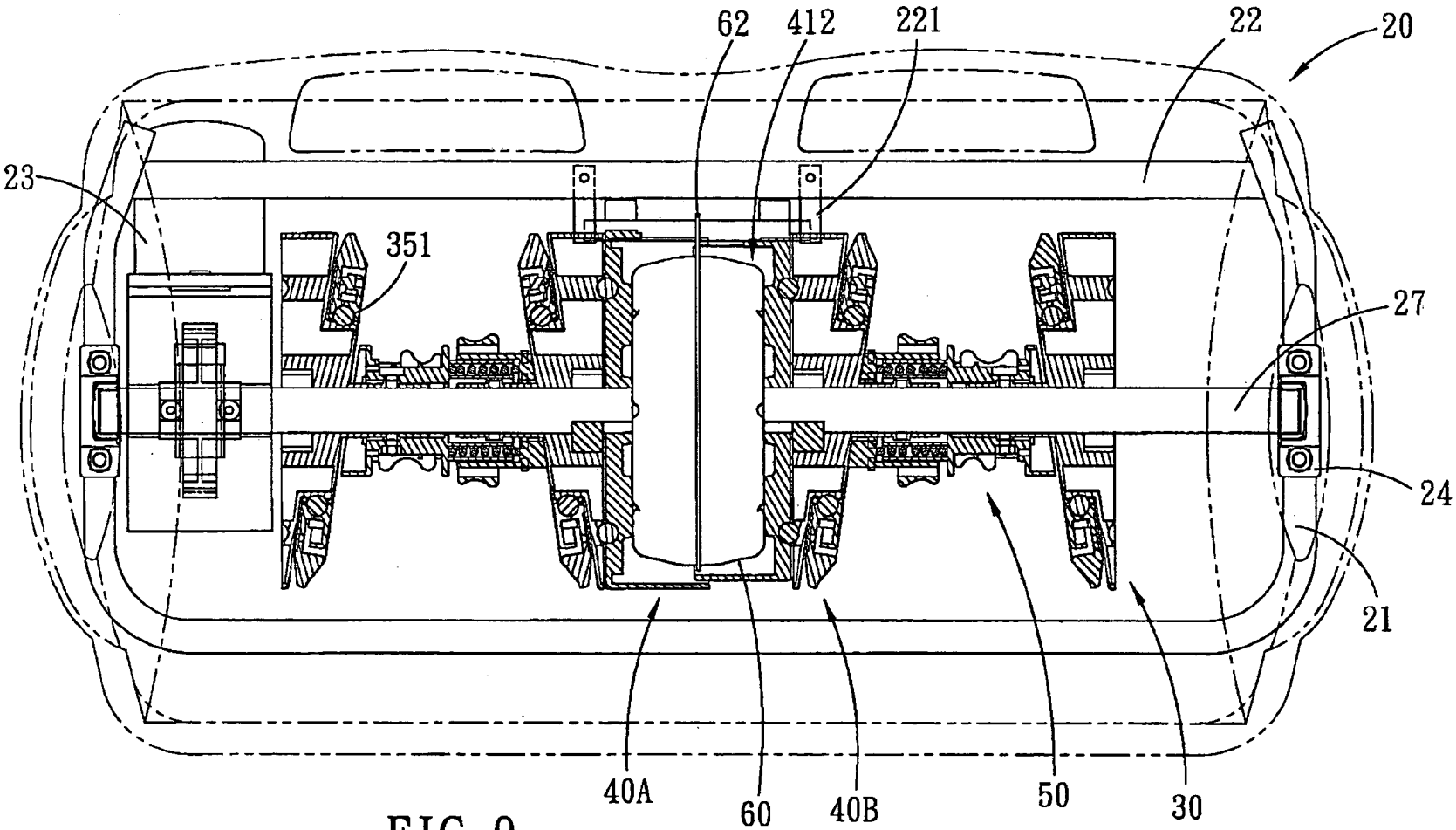
FIG. 9 is a top view of the air-pressure massaging device of FIG. 8.
Figure 10:
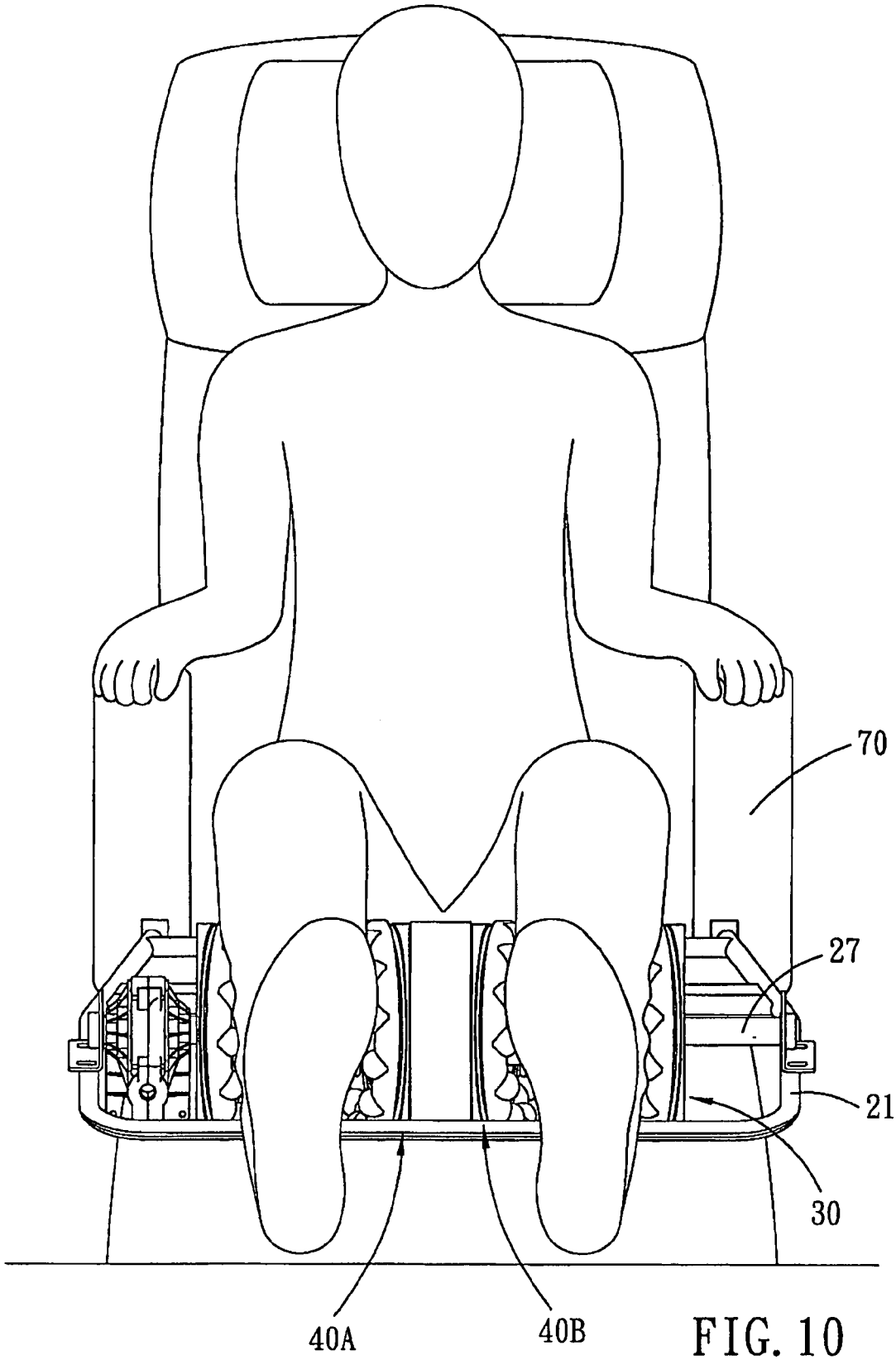
FIG. 10 is an operational view of an air-pressure massaging device in accordance with a second embodiment of the present invention.
Figure 11:
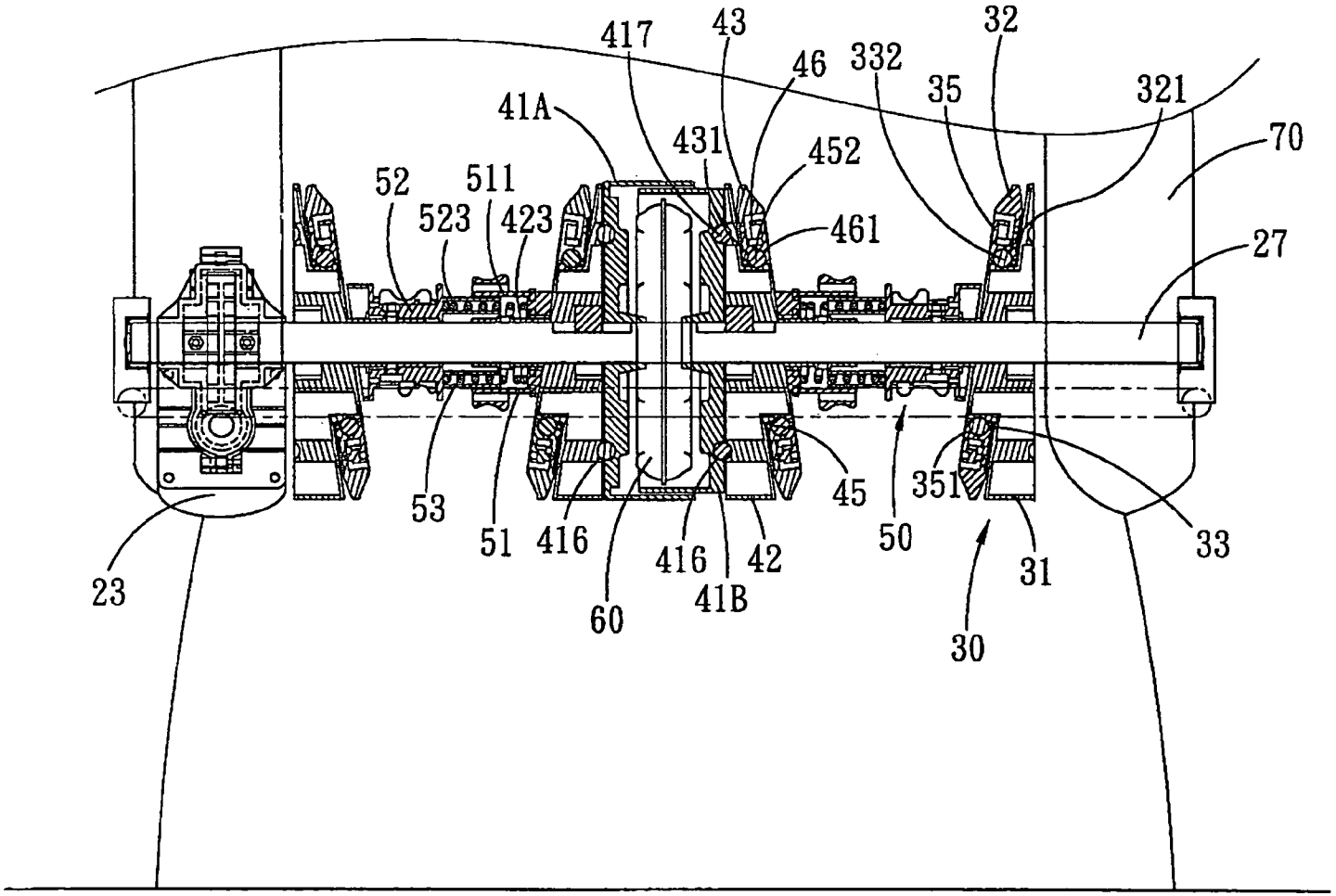
FIG. 11 is an assembly cross sectional view of the air-pressure massaging device in accordance with the second embodiment of the present invention.
Figure 12:
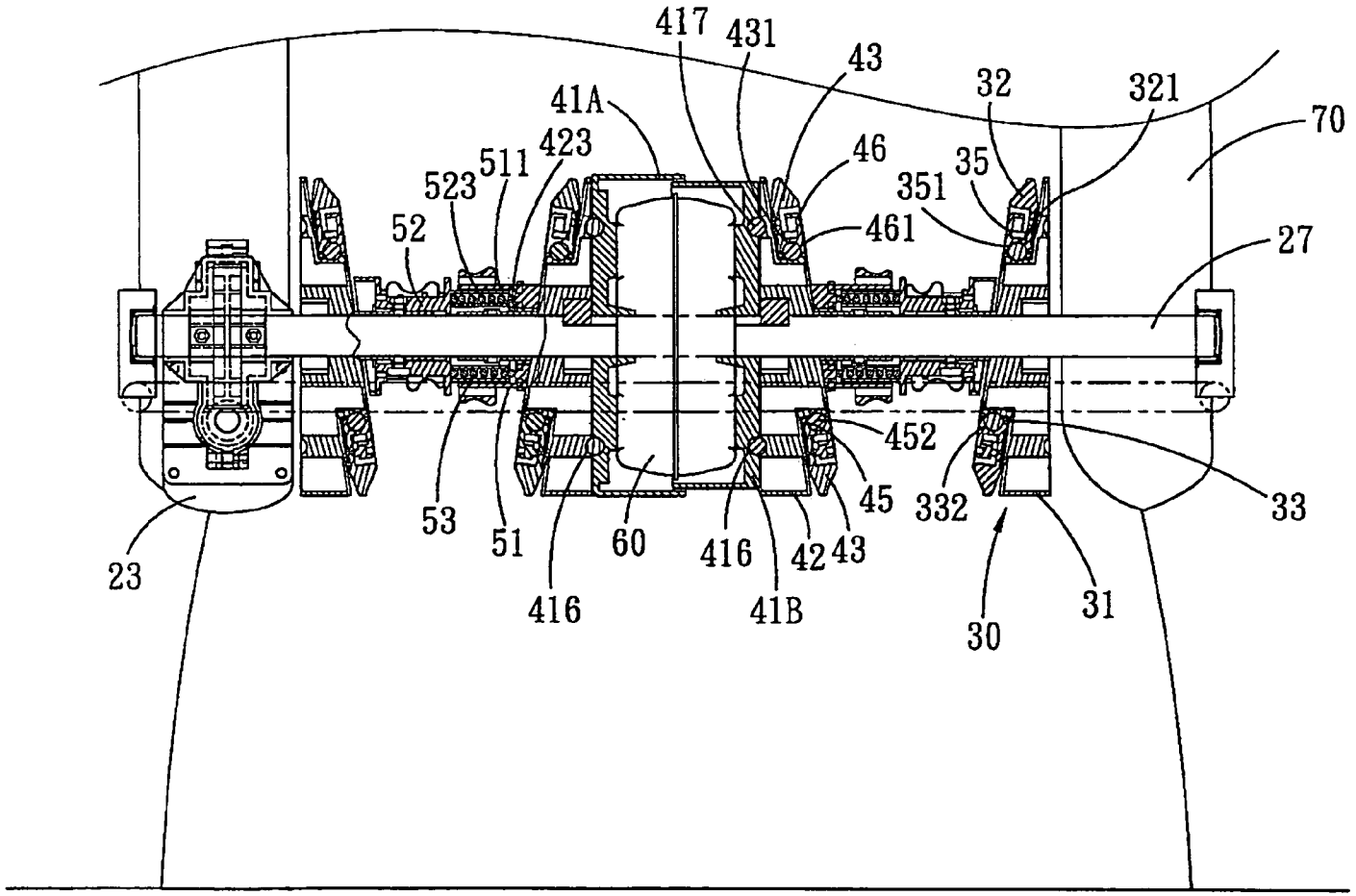
FIG. 12 is an cross sectional view of the air-pressure massaging device in accordance with the second embodiment of the present invention.
Figure 13:
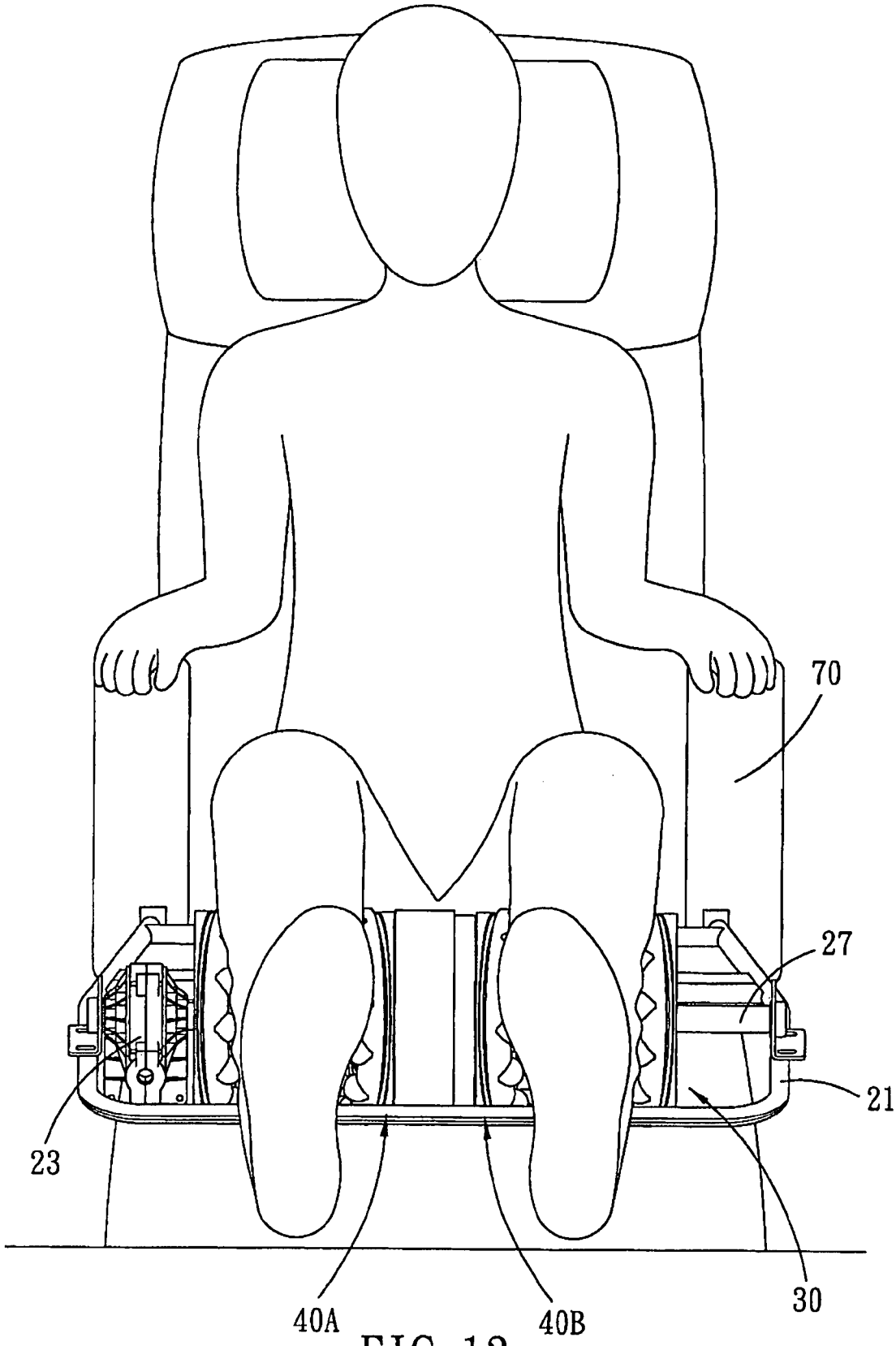
FIG. 13 is an illustrative view of the air-pressure massaging device in accordance with the second embodiment of the present invention.
Figure 14:
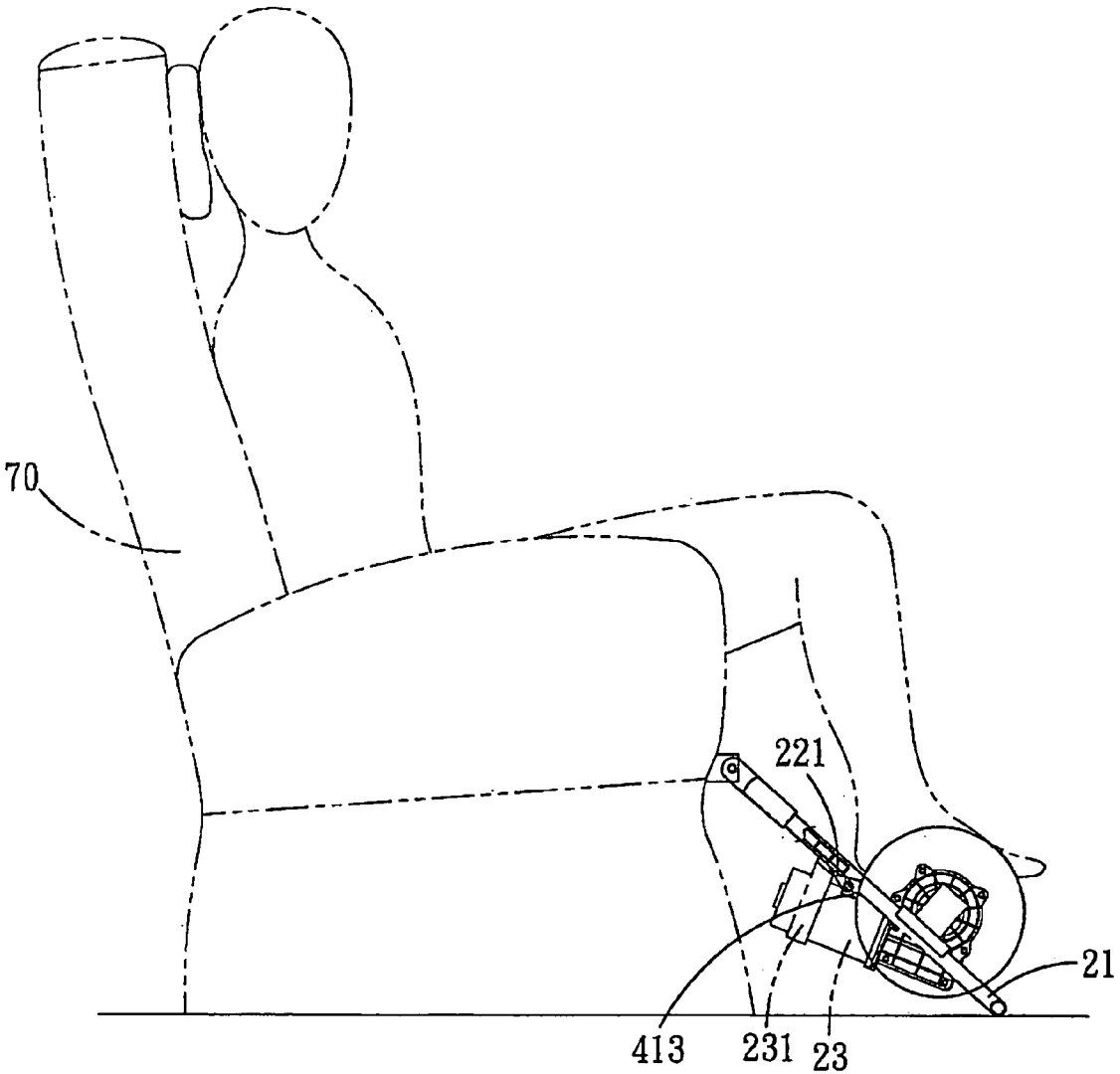
FIG. 14 shows the air-pressure massaging device in accordance with the second embodiment of the present invention is being used to massage the feet.

The base 20 is interiorly provided with a frame 21, as shown in FIG. 9, inside the frame 21 is a cross rod 22 which is locked with a reverse "Π" shaped stop member 221. A dynamic unit 23 is disposed on the frame 21 and firmly positioned on the cross rod 22 by using a positioning structure 231 (as shown in FIG. 14). At either side of the frame 21 is locked a pivot seat 24 having a pivot hole 241. A drive rod 27 is disposed between the pivot holes 241 of the respective pivot seats 24 by using a first pivot element 25 and a second pivot element 26 and is driven to rotate by the dynamic unit 23. On the surface of the drive rod 27 are provided two through holes 271 and two sliding grooves 272.

The two fixed massaging assemblies 30 are in the base 10 and located close to both ends of the drive rod 27, each of the fixed massaging assemblies 30 comprises a ring seat 31, a connecting ring 32, a ring 33, a press ring 34 and a limit ring 35. An end of the ring seat 31 is formed into the shape of a slant surface 311, a slant projection 312 and a slant connecting column 313 extend from the slant surface 311 in the axial directional thereof. On the periphery of the slant projection 312 is a formed positioning groove 314, and the ring seat 31 is axially defined with a through hole 315 through which the ring seat 31 is mounted onto the drive rod 27. The connecting column 313 is defined in the radial direction thereof with a through hole 316, so that the ring seat 31 is fixed to the drive rod 27 by passing a pin 317 through the through holes 271, 316. The connecting ring 32 is rotatably mounted onto the slant projection 312 of the ring seat 31 and is arranged at a predetermined angle, and an arc surface 321 is formed on the inner periphery of the connecting ring 32. On a side of the ring 33 are provided a plurality of ear portions 331 for fixing a ball 332, the ring 33 is mounted onto the slant projection 312 of the ring seat 31 in such a manner that the balls 332 at the ear portions 331 of the ring 33 are moveably received in the positioning groove 314 of the ring seat 31. The press ring 34 is rotatably positioned on the slant projection 312 of the ring seat 31 in such a manner that a side of the press ring 34 is locked with the connecting ring 32, while on another side of the press ring 34 are provided a plurality of massaging projections 341. The limit ring 35 is locked on another side of the press ring 34 having the massaging projections 341. An arc surface 351 is formed on the inner periphery of the limit ring 35 correspondingly to the balls 332 on the ring 33. Therefore, the connecting ring 32, the press ring 34 and the limit ring 35 are positioned on the slant projection 312 of the ring seat 31 via the ring 33, and are rotatable at a predetermined angle relative to the ring seat 31 under the effect of the balls 332 on the ring 33.

The two adjustable massaging assemblies 40A and 40B are mounted on both ends of the drive rod 27 in the base 20 and located between the two fixed massaging assemblies 30. The adjustable massaging assembly 40A—comprises a housing 41A, a movable ring seat 42, a connecting ring 43, a press ring 44, a ring 45 and a limit ring 46, and the adjustable massaging assembly 40B comprises a housing 41B, a movable ring seat 42, a connecting ring 43, a press ring 44, a ring 45 and a limit ring 46. Each of the housings 41A and 4B is axially provided with a through hole 411 through which the housings 41A and 41B are moveably mounted onto the drive rod 27. The housings 41A and 41B of the two adjustable massaging assemblies 40A and 40B are different in size, the small housing 41B is slideably received in the big housing 41A, and a receiving space 412 is defined after the two housings 41A and 4B are engaged with each other. Each of the housings 41A and 41B is provided on its periphery thereof with a positioning portion 413 for engaging with the stop member 221, so that the housings 41A and 41B are unable to rotate together with the drive rod 27. On the periphery of the each of the housings 41A and 41B is further provided with a first notch 414 and a second notch 415. The first notch 414 is located adjacent to the positioning portion 413. At the bottom surface of the housings 41A and 41B are provided a plurality of cavities 416 in each of which is received a ball 417. An end of the moveable ring seat 42 is formed into a slant surface 421, a slant projection 422 and a slant-connecting column 423 are extend from the slant surface 421 in the axial directional thereof. On the periphery of the slant projection 422 is a formed positioning groove 424, and the moveable ring seat 42 is axially defined with a through hole 425 through which the ring seat 421 is mounted onto the drive rod 27. A pair of inserting grooves 426 are oppositely disposed at both sides of the through hole 425 and located in line with the sliding grooves 272 of the drive rod 27. A T-shaped limit pin 427 inserted in the inserting grooves 426 and the sliding grooves 272 serves to allow a limit motion of the moveable ring seat 42 relative to the drive rod 27. Another end of the moveable ring seat 42 is provided with an annular groove 428. The connecting ring 43 is rotatably mounted onto the slant projection 422 of the moveable ring seat 42 and is arranged at a predetermined angle. On the inner periphery of the connecting ring 43 is formed an arc surface 431. The press ring 44 is rotatably mounted onto the slant projection 422 of the moveable ring seat 42, an end of the press ring 44 is locked with the connecting ring 44, and another end of the press ring 44 is provided with a plurality of massaging projections 441. The ring 45 is provided on its side surface with a plurality of ear portions 451 in each of which is received a ball 452. The ring 45 is also mounted onto the slant projection 422 of the moveable ring seat 42 in such a manner that the balls 452 in the ear portions 451 of the ring 45 are moveably received in the positioning groove 424. The limit ring 46 is locked on the side of the press ring 44 having the massaging projections 441, an arc surface 461 is formed on the inner periphery of the limit ring 46 correspondingly to the balls 452. By such arrangements, the housings 41A and 41B, the moveable ring seat 42, the connecting ring 43, the press ring 44, the ring 45 and the limit ring 46 are confined in the sliding groove 272 of the drive rod 27 by the limit pin 427 on the moveable ring seat 42, and are moveable relative to the drive rod 27.

Each of the massaging wheel assemblies 50 comprises a sleeve 51, an assembling pipe 52 and a return element 53. The sleeve 51 is mounted onto the drive rod 27 of the base 20, and an end of the sleeve 51 is mounted onto the connecting column 423 on the moveable ring seat 42 of the adjustable massaging assembly 40 and is locked thereon. Formed inside the sleeve 51 is an annular step groove 511, and another end of the sleeve 51 is a free end, on the periphery of the free end of the sleeve 51 are provided a plurality of massaging blocks 512. The assembling pipe 52 is mounted onto the drive rod 27 of the base 20, a first end of the assembling pipe 52 is mounted onto the connecting column 313 on the ring seat 31 of the fixed massaging assemblies 30 in such a manner that a through axial hole 521 of the assembling pipe 52 is aligned to the through hole 316 of the ring seat 31, and a pin 317 is inserted through the axial hole 521 and the through hole 316 to fix the assembling pipe 52 on the ring seat 31. On the periphery of this first end of the assembling pipe 52 are provided a plurality of massaging rollers 522. A second end of the assembling pipe 52 extends into the annular step groove 51 of the sleeve 51, at this end of the assembling pipe 52 is formed an annular receiving groove 523, and adjacent to the annular receiving groove 523 is formed an annular flange 524 correspondingly to the free end of and the massaging blocks 512 of the sleeve 51. The return element 53 in this embodiment is a return spring for example, which is disposed in the annular receiving groove 523 of the assembling pipe 52 and biased between the bottom of the annular receiving groove 523 and the edge of the annular step groove 511 of the sleeve 51.

The airbag 60 is ring-shaped and mounted onto the drive rod 27 and located in the receiving space 412 between the two housings 41A and 41B of the adjustable massaging assemblies 40A and 40B. The airbag 60 is provided with an air-inlet structure 61 extending out of the second notch 415 of the housing 41A, and on the outer periphery of the airbag 60 is formed a retaining portion 62 for insertion of the stop member 221 of the base 20 so as to prevent the airbag 60 rotating together with the drive rod 27.

Figure 1:
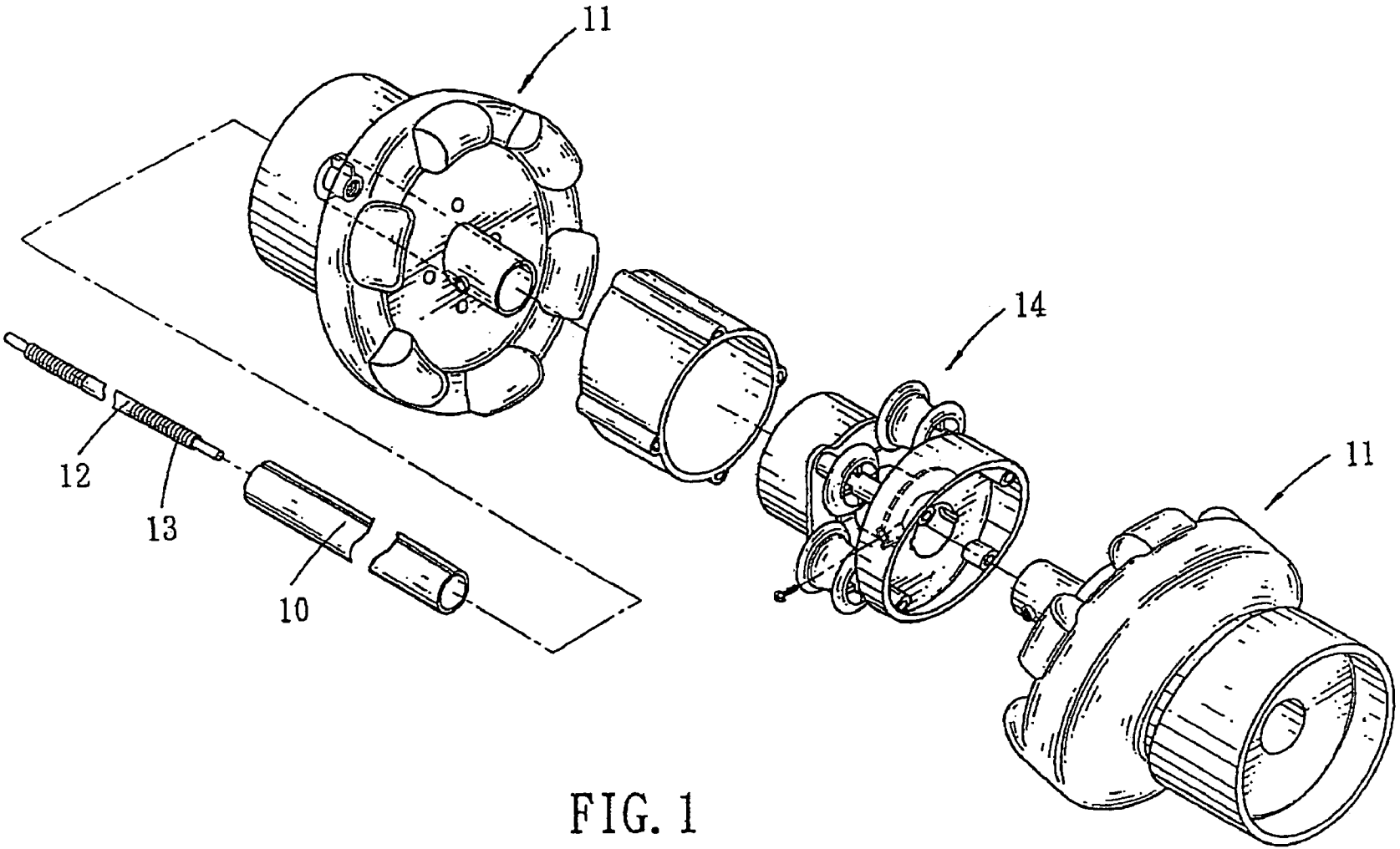
FIG. 1 PRIOR ART
FIG. 1 is an exploded view of a conventional massaging device.
Figure 2:
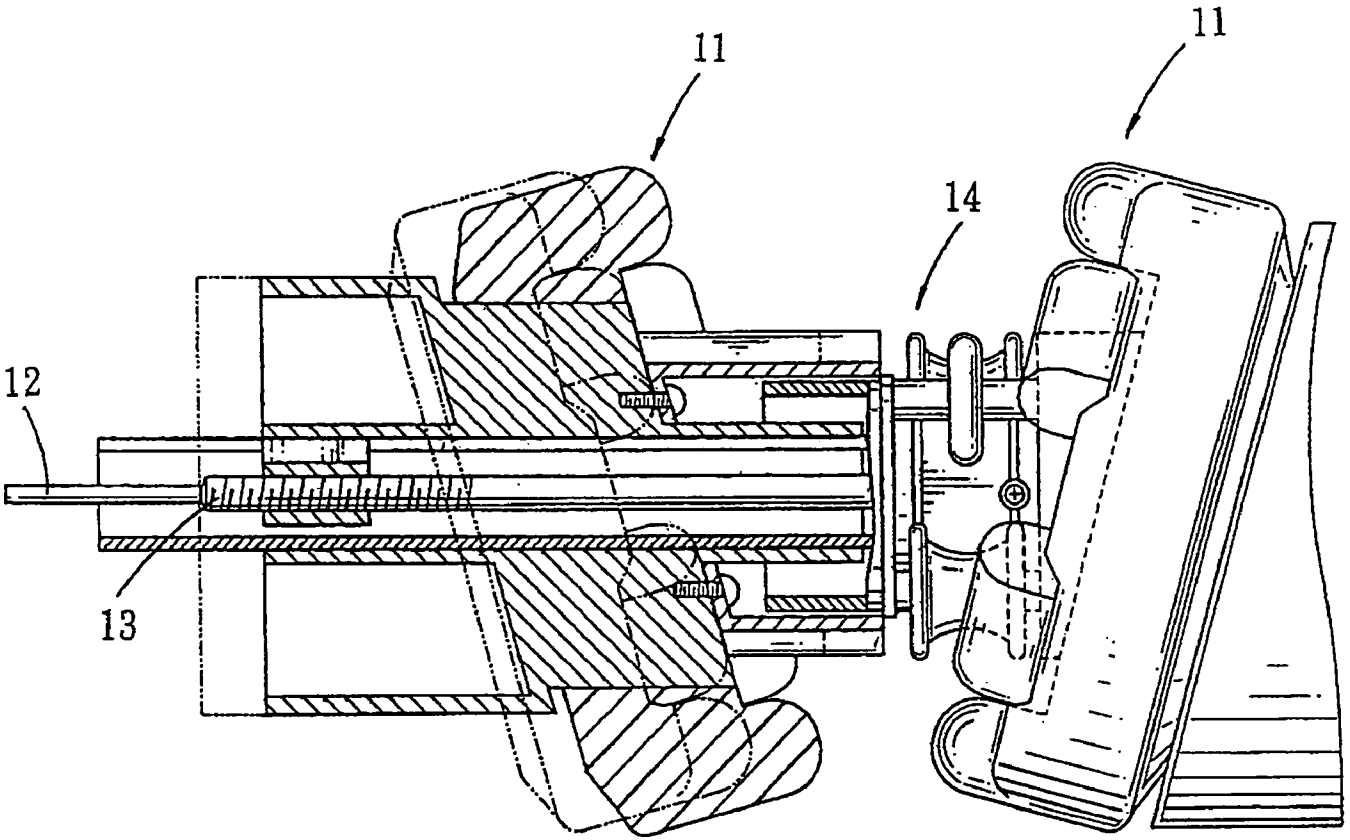
FIG. 2 PRIOR ART
FIG. 2 is a cross sectional view of a conventional massaging device.
Figure 3:
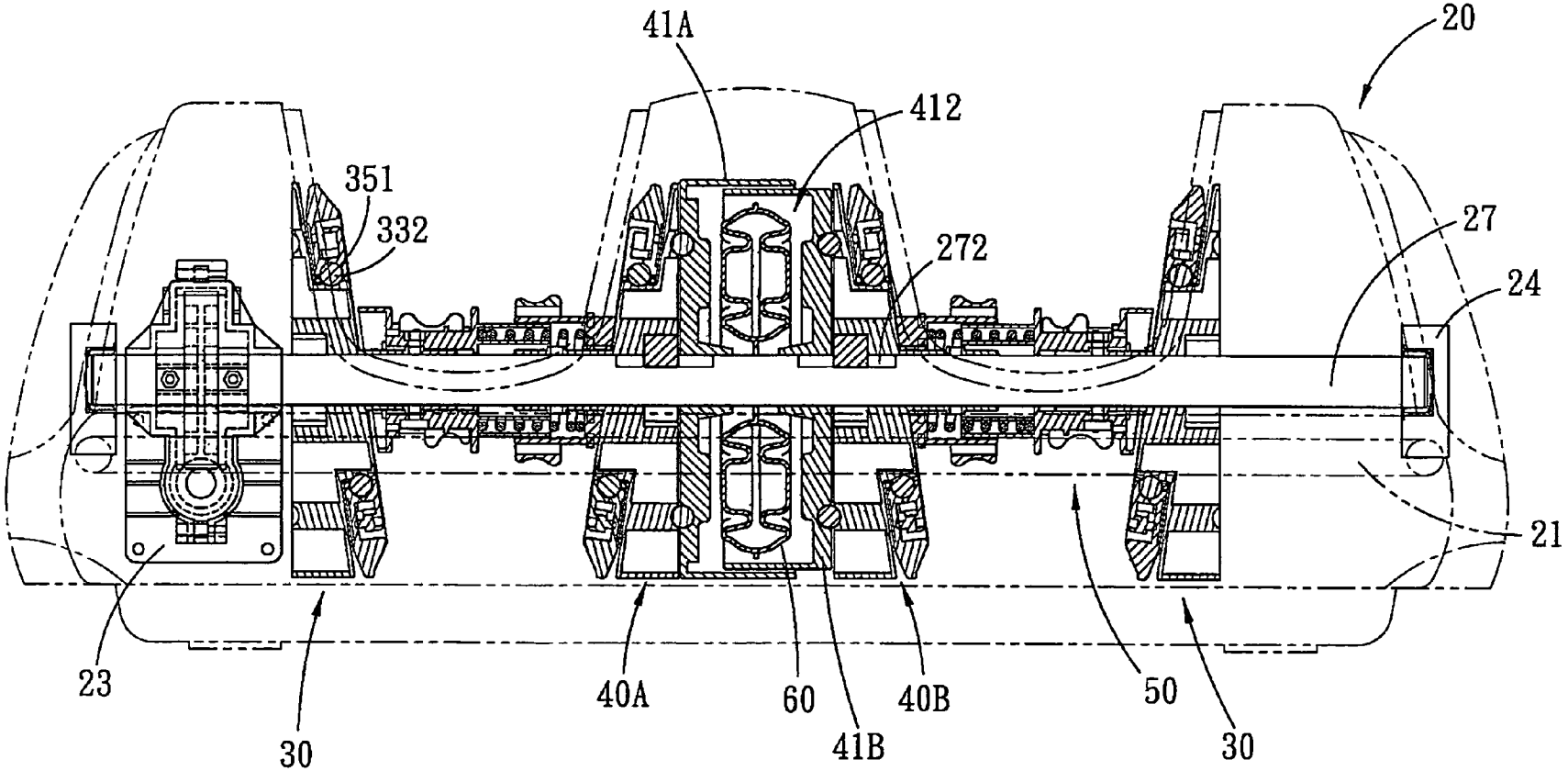
FIG. 3 is an assembly cross sectional view of an air-pressure massaging device in accordance with the present invention.
Figure 4:
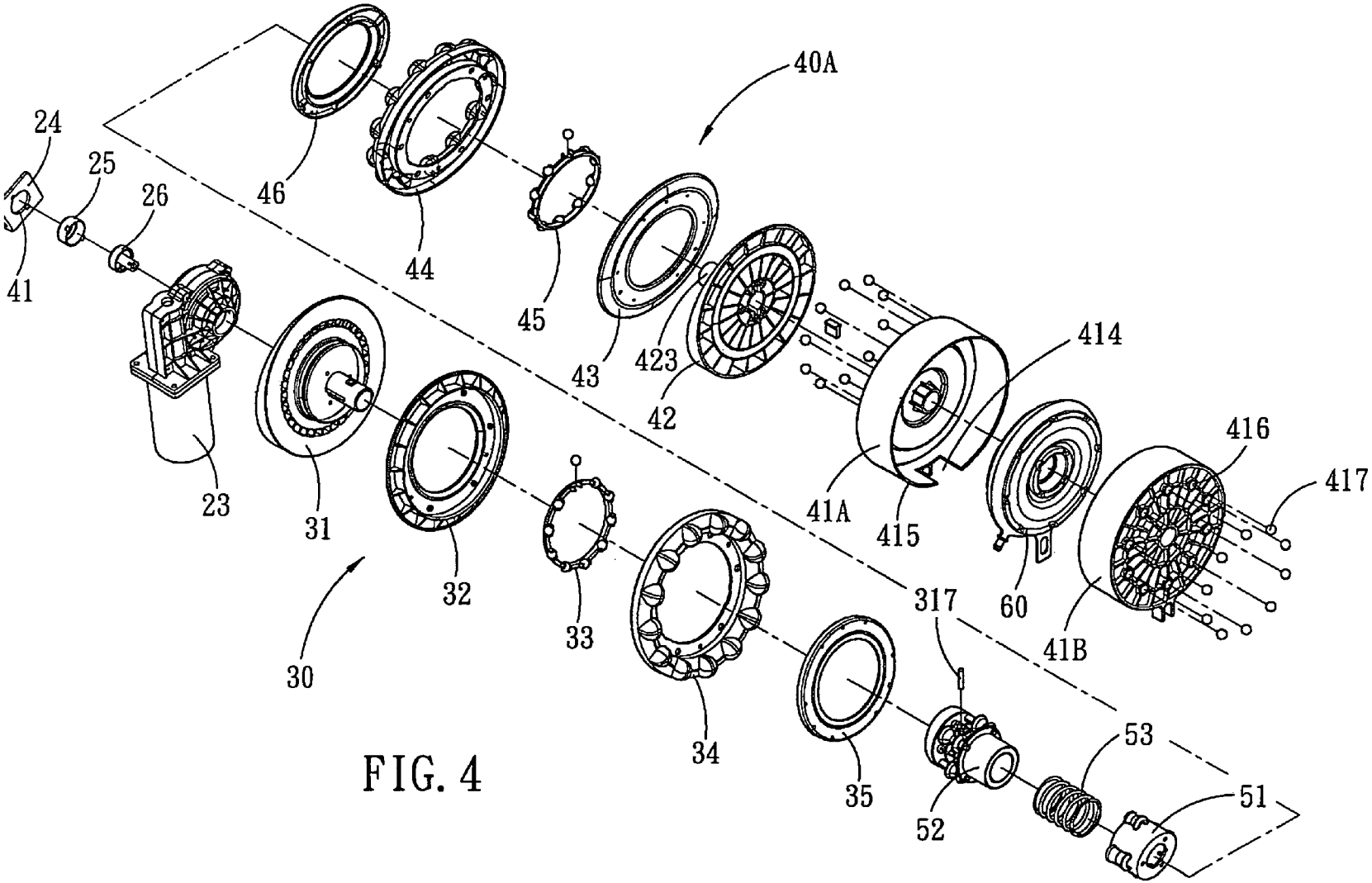
FIG. 4 is an exploded view of part of an air-pressure massaging device in accordance with the present invention.
Figure 5:
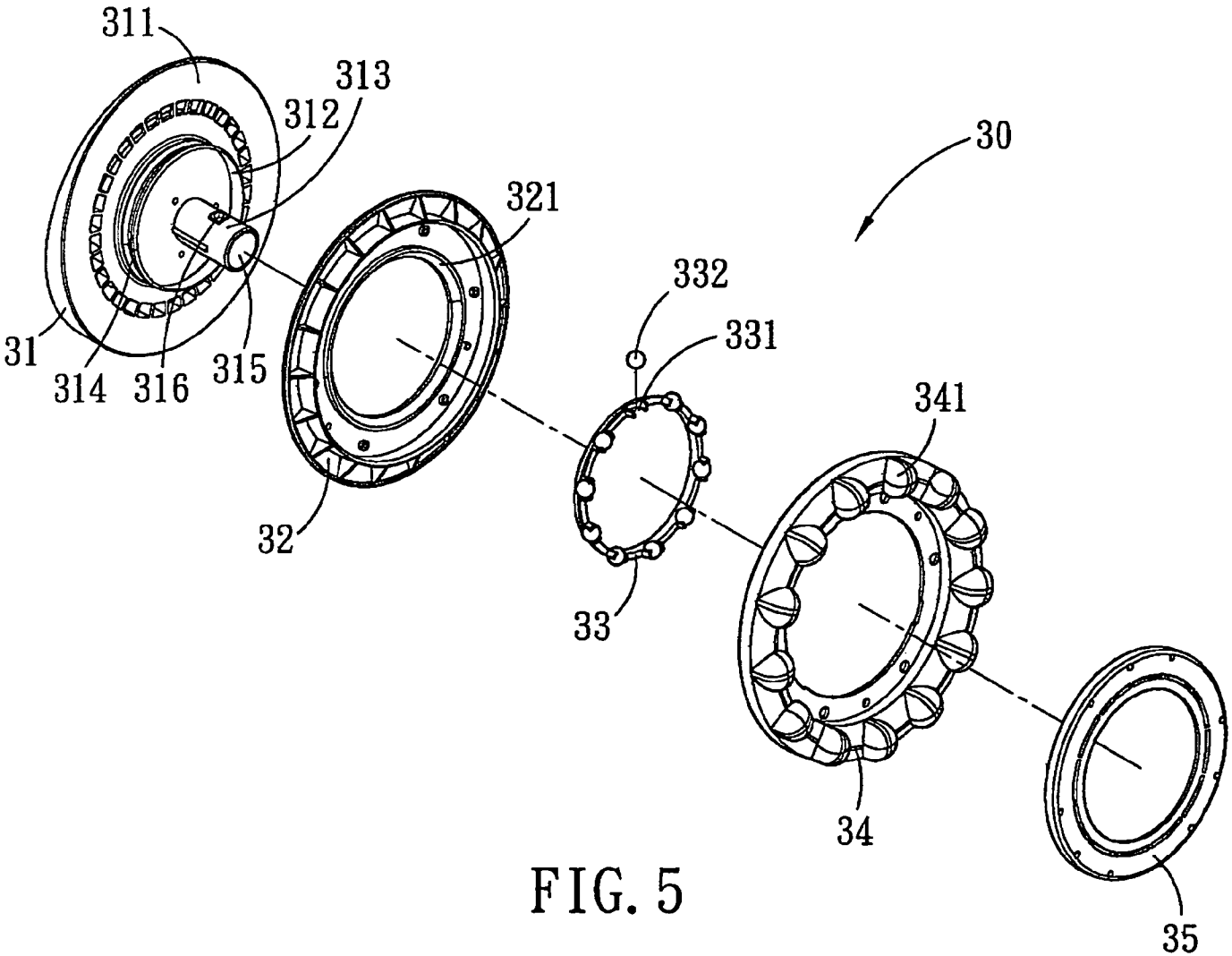
FIG. 5 is an exploded view of part of a fixed massaging assembly in accordance with the present invention.
Figure 6:
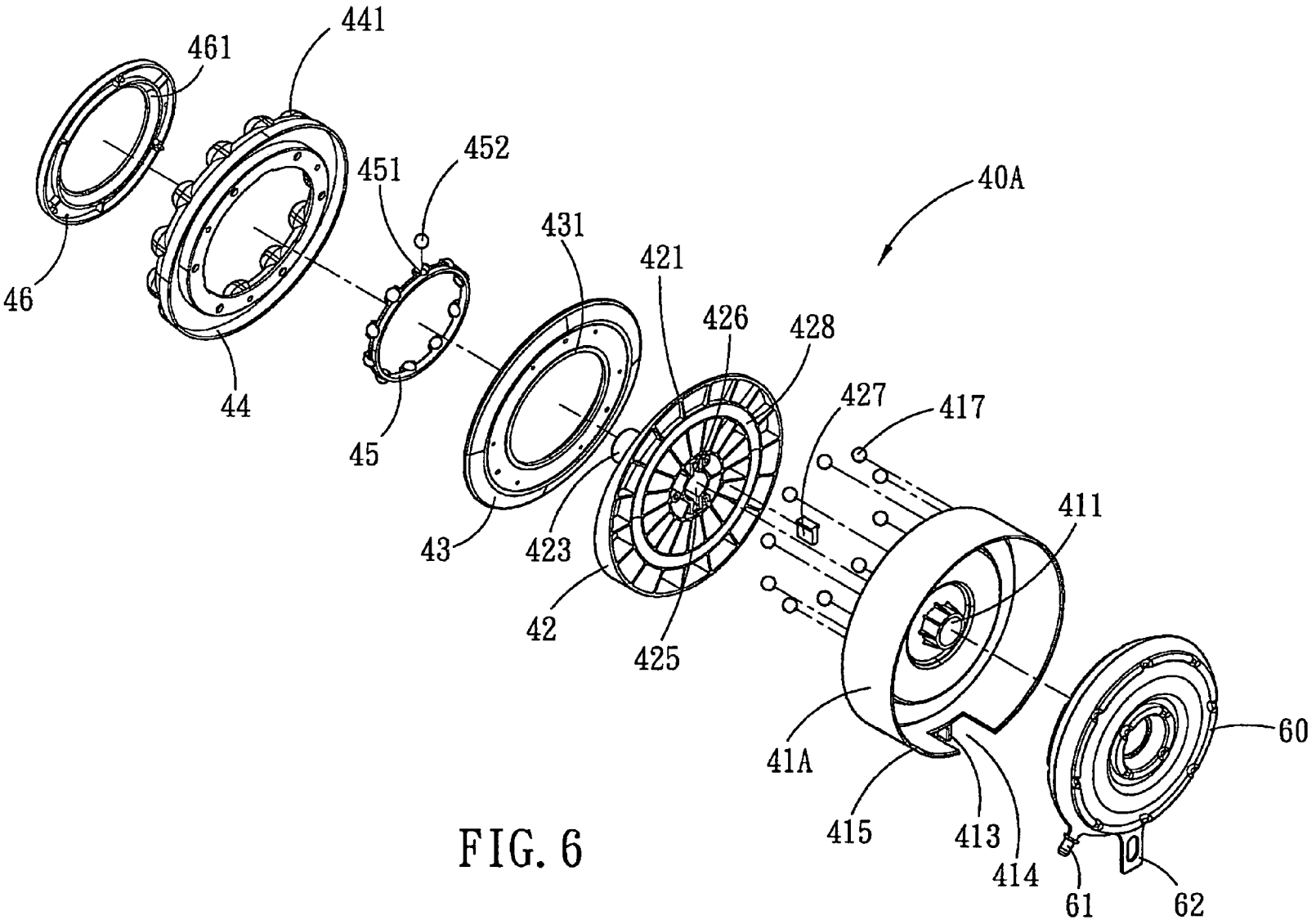
FIG. 6 is an exploded view of part of an adjustable massaging assembly in accordance with the present invention.
Figure 7:
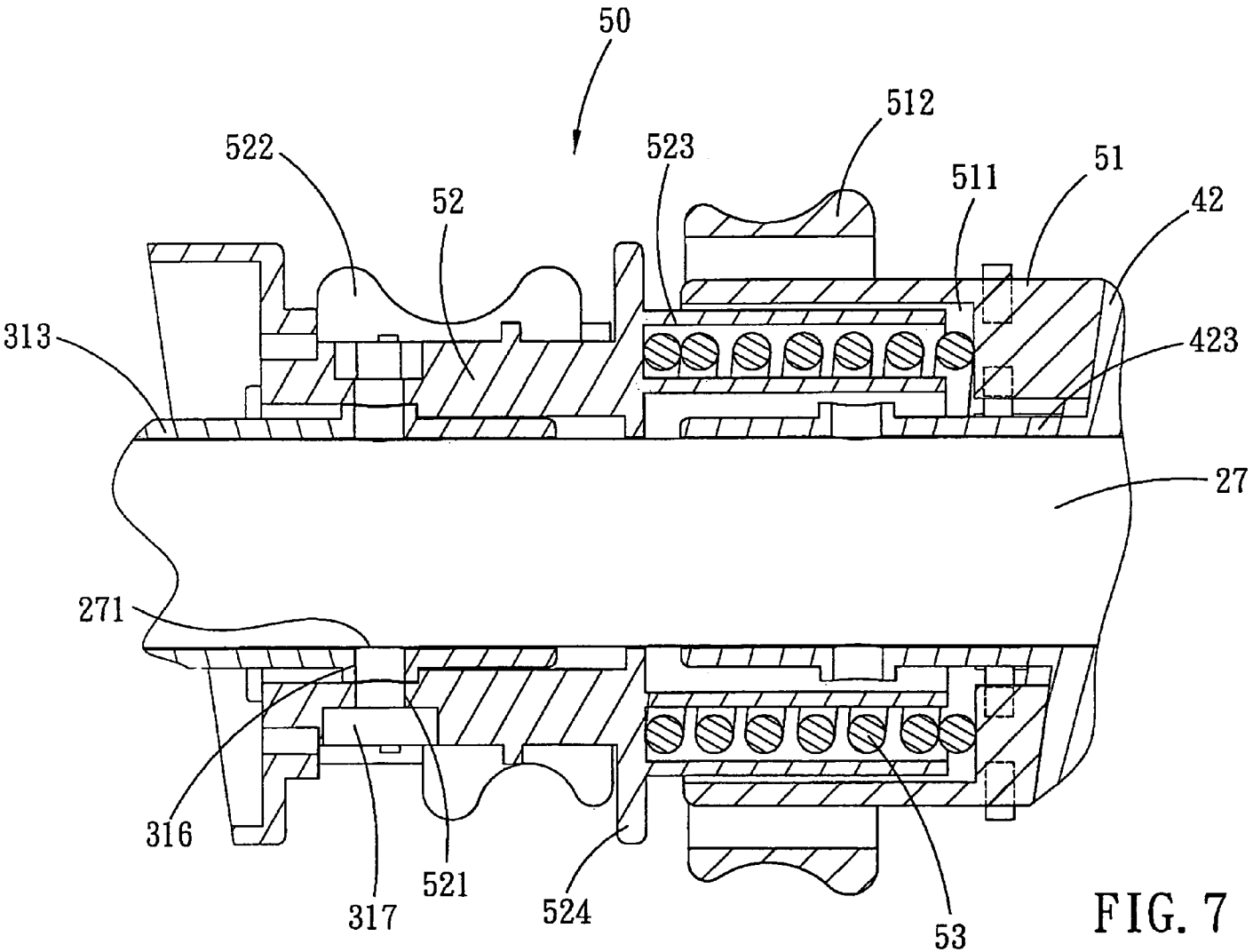
FIG. 7 is an assembly cross sectional view of a massaging wheel assembly in accordance with the present invention.
Figure 8:
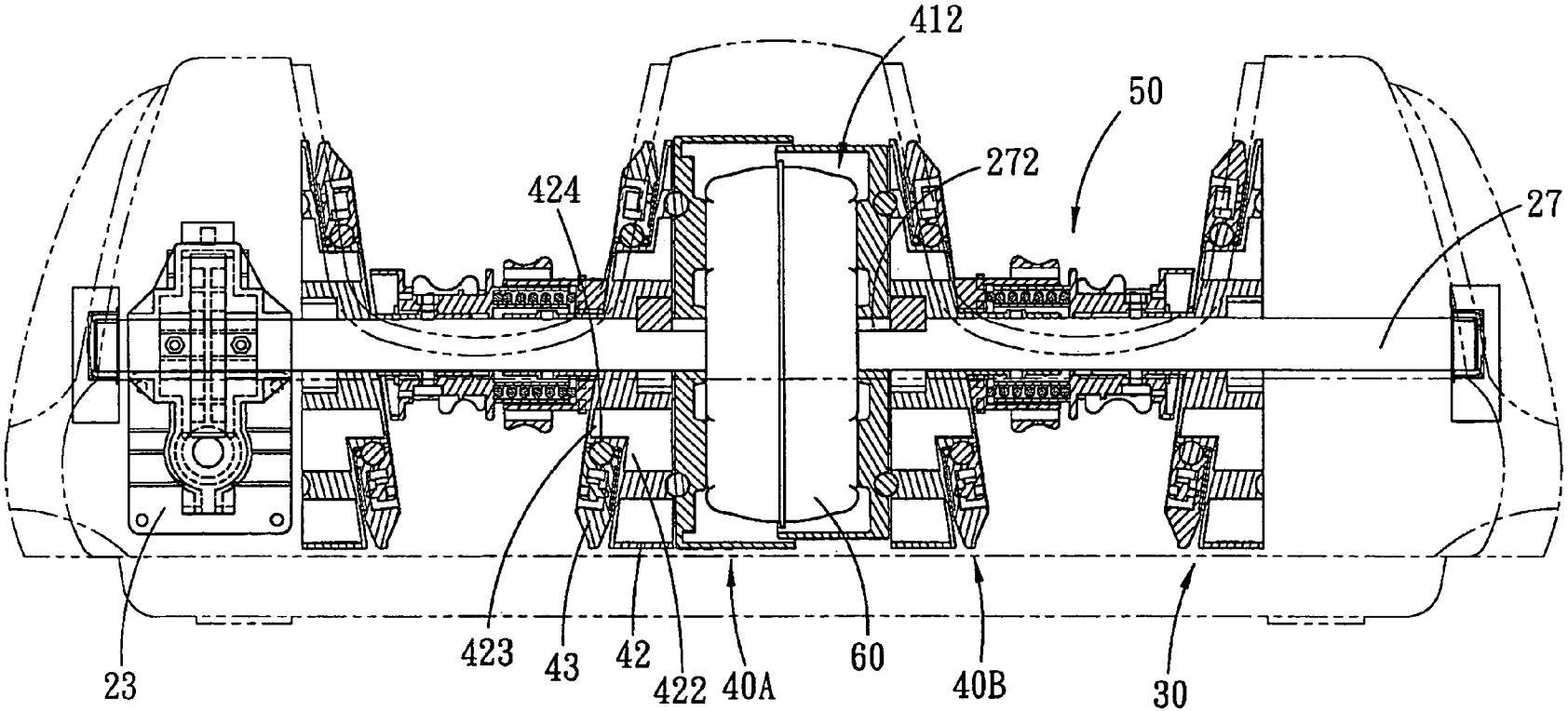
FIG. 8 is a cross sectional view of the air-pressure massaging device in accordance with the present invention.

Referring to FIGS. 3, 8 and 9, the user can put his/her feet directly on the massaging wheel assemblies 50, the dynamic unit 23 will rotate the drive rod 27, and then the drive rod 27 subsequently rotates the adjustable massaging assemblies 40A and 40B, the fixed massaging assemblies 30 and the massaging wheel assemblies 50. Meanwhile, an air source is used to make the airbag 60 inflate and deflate, the inflation and deflation of the airbag 60 can cause displacement of the adjustable massaging assemblies 40A and 40B, thus adjusting the distance between the adjustable massaging assemblies 40A and 40B and the fixed massaging assemblies 30.

The massaging device of the present invention also can be disposed at the lower portion of a chair where the use's legs are supported, with reference to FIGS. 10-13, the user can sit on a chair 70, putting his/her legs between the fixed massaging assembly 30 and the massaging assemblies 40A and 40B. The dynamic unit 23 will rotate the drive rod 27, and then the drive rod 27 subsequently rotates the adjustable massaging assemblies 40A and 40B, the fixed massaging assemblies 30 and the massaging wheel assemblies 50.

Since the positioning portion 413 of the housings 41A, 41B of each of the adjustable assemblies 40A and 40B is used to engage with the stop member 221 of the frame 21, the stop member 221 will stop the housings 41A and 41B from rotating together with the drive rod 27 (as shown in FIG. 14).

When the dynamic unit 23 rotates the drive rod 27, the ring seat 31 and moveable ring seat 42 will be caused to oscillate in the axial direction of the drive rod 27.

During the oscillation of the ring seat 31 and moveable ring seat 42 in the axial direction of the drive rod 27, the balls 332 on the ring 33 of the ring seat 31 will slide relatively on the arc surface 321 of the connecting ring 32. At this moment, the connecting ring 32 is locked with the press ring 34 and the limit ring 35, so that the press ring 34 will be enabled to rotate relative to the ring seat 31.

Furthermore, the balls 452 on the ring 45 of the moveable ring seat 42 of the adjustable massaging assemblies 40A and 40B will roll on the arc surface 431 of the connecting ring 43, and the balls 417 in the cavities 416 of the housings 41A and 41B will slide in the annular groove 428 of the each moveable ring seat 42. Meanwhile, the connecting ring 43 is locked with the press ring 44 and the limit ring 46, hence, the press ring 44 is enabled to rotate relative to the moveable ring seat 42.

At this moment, the airbag 60 is inflated by the air source under the control of the user, so as to push the housings 41A and 41B of the adjustable massaging assemblies 40A and 40B to move, the distance between the adjustable massaging assemblies 40A, 40B and the fixed massaging assembly 30 can be effectively adjusted to fit different users through the inflation and the deflation of the air bag, and accordingly the massaging force can be controlled.

When the adjustable massaging assemblies 40A and 40B move relative to the fixed massaging assembly 30, the sleeve 51 moves along with the moveable ring seat 42 of the respective adjustable massaging assemblies 40A and 40B in the axial direction of the drive rod 27 since it is positioned on the connecting column 423 of the moveable ring seat 42 of the respective adjustable massaging assemblies 40A and 40B. Meanwhile, the annular step groove 511 of the sleeve 51 will compress the return element 53.

When the user turn the dynamic unit 23 off, the airbag 60 will be deflated, and the housing 41 of the respective adjustable massaging assemblies 40A and 40B will not be pushed by airbag 60 anymore. Therefore, the return element 53 will not be compressed by the annular step groove 511 of the sleeve 51 and will be stretched to push the sleeve 51, so that the moveable ring seat 42 on the sleeve 51 is caused to move away from the fixed massaging assembly 30 in the axial direction of drive rod 27. Meanwhile, the dynamic unit 23 will use the drive rod 27 to make the adjustable massaging assembly 40 and the fixed massaging assembly 30 to their original positions, so as to free the user's leg from the clamp between the adjustable massaging assembly 40 and the fixed massaging assembly 30.

The retaining portion 62 of the airbag 60 is positioned on the stop member 221, so that, during inflation process, the airbag 60 will be evenly inflated to push the housings 41A and 41B at both sides thereof.

In addition, the ring seat 31 and the moveable ring seat 42 are structurally identical to each other, and the connecting rings 32, 43, the press rings 34, 44, the rings 33, 45 and the limit rings 35, 46 of the fixed massaging assembly 30 and the moveable massaging assembly 40 are structurally the same. Hence, the production cost of the present invention can be reduced.

When the adjustable massaging assemblies 40A and 40B are massaging, the counteracting force to the massaging force thereof will cause a slight press on the airbag 60, and through repeat inflation and deflation of the airbag 60, the massaging force of the massaging device of the present invention is effectively controlled to a comfortable level.

Figure 15:
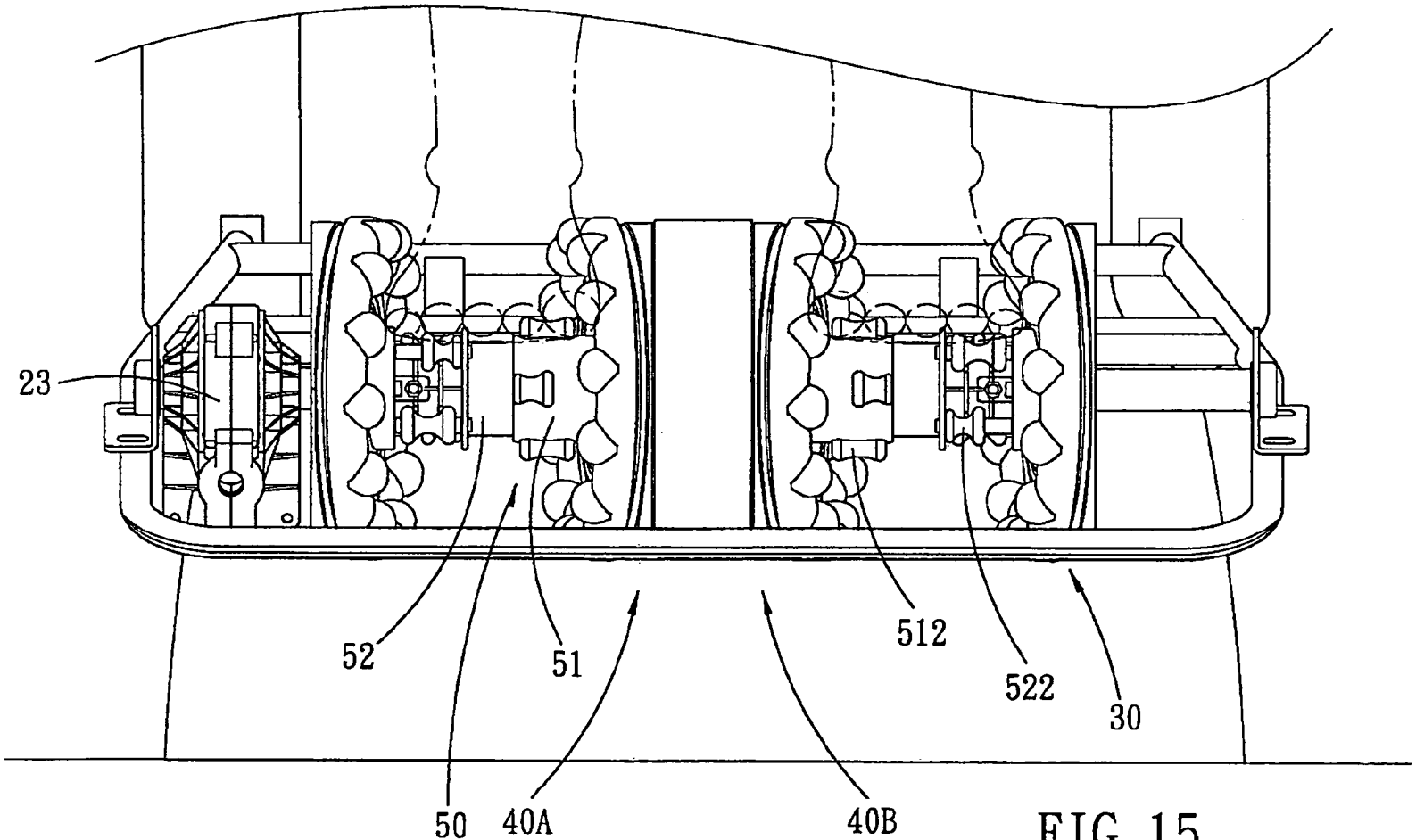
FIG. 15 is an enlarged view of part of FIG. 14.

The massaging device of the invention also can be used to massage the ankle and foot, as shown in FIGS. 14 and 15, the user puts his/her feet on the massaging rollers 522 of the assembling pipe 52 and on the massaging blocks 512 of the sleeve 51, and the ankles are located between the adjustable massaging assemblies 40A, 40B and the fixed massaging assembly 30.

Figure 16:
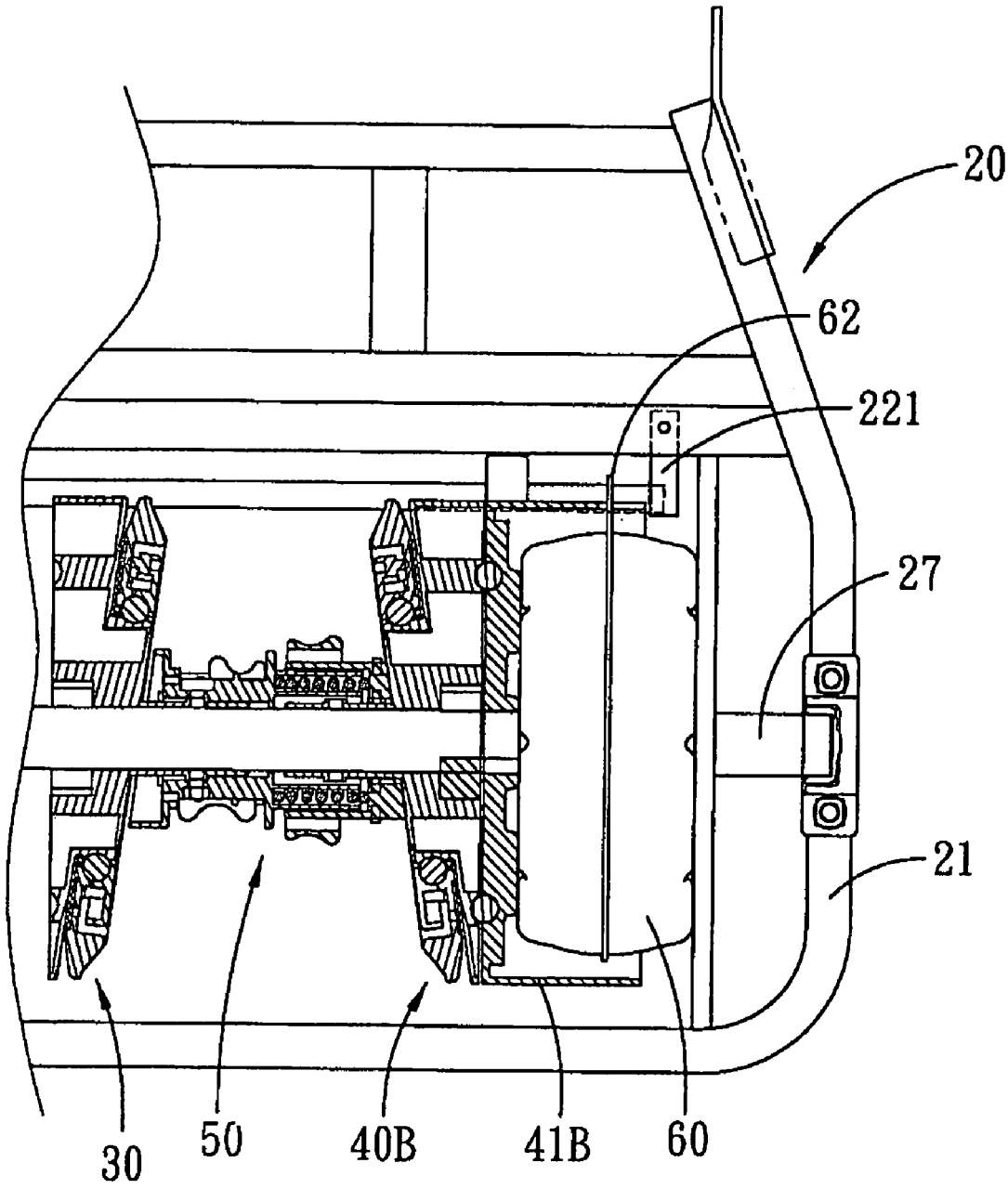
FIG. 16 is a cross sectional view of part of an air-pressure massaging device in accordance with a third embodiment of the present invention.

As mentioned above, the airbag 60 is used to push the adjustable massaging assemblies 40A and 40B at both sides thereof, and alternatively, the airbag 60 also can be disposed at either end of the drive rod 27, and the two adjustable massaging assemblies 40A and 40B are disposed between the two airbags 60. The two fixed massaging assemblies 30 can be between the two adjustable massaging assemblies 40A and 40B, as shown in FIG. 16, and the structural relationships between the respective components are explained as follows:

At either end of the inner space of the frame 21 in the base 20 is disposed a fixing board 28, and at a side of the fixing board 28 is disposed an airbag 60 facing toward the housings 41A and 41B of the adjustable massaging assemblies 40A and 40B. The airbag 60 can be inflated to push the respective adjustable massing assemblies 40A and 40B to move relative to fixed massaging assembly 30 along the axial direction of the drive rod 27.

The air source as mentioned above can be air pump or a balloon, so that the airbag 60 can be inflated and deflated automatically by the air pump or manually by pressing the balloon. Furthermore, the air pump uses CPU (central processing unit) to control the time of the inflation and deflation of the airbag 60.

It will be noted that FIGS. 3, 8, 9, 11, 12 and 16 don't show the press rings 34, 44.

While we have shown and described various embodiments in accordance with the present invention, it should be clear to those skilled in the art that further embodiments may be made without departing from the scope of the present invention.

What is claimed is:

1. An air-pressure massaging device having an automatic adjustment function comprising:

a base, inside which being disposed a drive rod;

two fixed massaging assemblies mounted onto both ends of the drive rod;

two adjustable massaging assemblies moveably mounted onto the drive rod and located between the two fixed massaging assemblies;

an airbag disposed in the base and serving to move the adjustable massaging assemblies relative to the fixed massaging assemblies;

through inflation and deflation of the airbag, the adjustable massaging assemblies will be caused to move relative to the fixed massaging assemblies, so that a distance between the fixed massaging assemblies and the adjustable massaging assemblies is adjusted.

2. The air-pressure massaging device having an automatic adjustment function as claimed in claim 1, wherein a frame is disposed in the base and provided for transversely and pivotally positioning the drive rod.

3. The air-pressure massaging device having an automatic adjustment function as claimed in claim 2, wherein a dynamic unit is fixed on the frame and used to rotate the drive rod.

4. The air-pressure massaging device having an automatic adjustment function as claimed in claim 2, wherein a stop member is provided on the frame of the base, and a positioning portion is formed on a housing of the respective adjustable massaging assemblies and employed to be locked with the stop member of the frame, so that the housing of the adjustable massaging assemblies is unable to rotate together with the drive rod.

5. The air-pressure massaging device having an automatic adjustment function as claimed in claim 2, wherein a fixing board is disposed at either end of an inner space of the frame in the base, and at a side of the fixing board is disposed the airbag which faces toward the adjustable massaging assembly, the airbag is inflated to push the adjustable massing assemblies to move relative to the fixed massaging assemblies along the axial direction of the drive rod.

6. The air-pressure massaging device having an automatic adjustment function as claimed in claim 1, wherein the two fixed massaging assemblies are disposed at both ends of the drive rod, and the two adjustable massaging assemblies are mounted on the drive rod and located between the two fixed massaging assemblies, the airbag is located in the base, and the two adjustable massaging assemblies are disposed at both sides of the airbag.

7. The air-pressure massaging device having an automatic adjustment function as claimed in claim 6, wherein each of the fixed massaging assemblies comprises a ring seat, a connecting ring, a ring, a press ring and a limit ring, the ring seat is fixed on the drive rod and is provided with a slant projection, the ring is positioned on the slant projection of the ring seat, the ring is provided with a plurality of ear portions in each of which is disposed a ball, the connecting ring is mutually locked with the press ring and the limit ring and is positioned on the balls in the ear portions of the ring, so that the connecting ring, the press ring and the limit ring are rotatably and slantwise arranged relative to the ring seat of the fixed massaging assembly.

8. The air-pressure massaging device having an automatic adjustment function as claimed in claim 7, wherein each of the adjustable massaging assemblies comprises a housing, a movable ring seat, a connecting ring, a press ring, a ring and a limit ring, the housing of the adjustable massaging assembly is axially provided with a through hole through which the housing of the adjustable massaging assembly is moveably mounted onto the drive rod, the housings of the respective adjustable massaging assemblies are located correspondingly to each other and define a receiving space therebetween, the moveable ring seat is axially provided with a through hole through which the moveable ring seat is moveably mounted onto the drive rod, the ring of the adjustable massaging assembly is positioned on a slant projection of the moveable ring seat and is provided with a plurality of ear portions in each of which is received a ball, the connecting ring of the adjustable massaging assembly is locked with the press ring and the limit ring thereof and is positioned on the balls in the ear portions of the ring of the adjustable massaging assembly so that the connecting ring, the press ring and the limit ring are rotatably and slantwise arranged relative to the ring seat of the adjustable massaging assembly.

9. The air-pressure massaging device having an automatic adjustment function as claimed in claim 8, wherein each of the adjustable massaging assemblies is provided at its end facing the fixed massaging assemblies with a plurality of massaging projections.

10. The air-pressure massaging device having an automatic adjustment function as claimed in claim 8, wherein the ring seat of the respective adjustable massaging assemblies is provided at its end facing the fixed massaging assemblies with a slant surface.

11. The air-pressure massaging device having an automatic adjustment function as claimed in claim 8, wherein a plurality of cavities are annularly arranged on an end surface of the housing, an annular groove is correspondingly formed on end surface of the moveable ring seat, a plurality balls are received in the cavities and the annular groove, so that the moveable ring seat is able to rotate relative to the housing.

12. The air-pressure massaging device having an automatic adjustment function as claimed in claim 8, wherein a massaging wheel assembly is disposed between each pair of the fixed massaging assembly and the adjustable massaging assembly, and includes a sleeve, an assembling pipe and a return element, a connecting column is formed on the slant projection of the moveable ring seat of the respective adjustable massaging assemblies, the sleeve is mounted to the drive rod and engaged with the connecting column of the moveable ring seat, on the slant projection of the ring seat of the fixed massaging assemblies is also provided a connecting column, the assembling sleeve is mounted to the drive rod and engaged with the connecting column of the fixed ring seat, on a periphery of the assembling pipe are provided a plurality of massaging rollers, another end of the assembling pipe extends into an annular step groove of the sleeve, at this another end of the assembling pipe is formed an annular receiving groove, the return element is disposed in the annular receiving groove of the assembling pipe and biased between a bottom of the annular receiving groove and an edge of the annular step groove of the sleeve.

13. The air-pressure massaging device having an automatic adjustment function as claimed in claim 12, wherein an annular flange is formed on the periphery of the assembling pipe of the massaging wheel assembly.

14. The air-pressure massaging device having an automatic adjustment function as claimed in claim 7, wherein each of the fixed massaging assemblies is provided at its end facing the adjustable massaging assemblies with a plurality of massaging projections.

15. The air-pressure massaging device having an automatic adjustment function as claimed in claim 7, wherein the ring seat of the respective fixed massaging assemblies is provided at its end facing the adjustable massaging assemblies with a slant surface.

16. The air-pressure massaging device having an automatic adjustment function as claimed in claim 7, wherein a massaging wheel assembly is disposed between each pair of the fixed massaging assembly and the adjustable massaging assembly, and includes a sleeve, an assembling pipe and a return element, a connecting column is formed on the slant projection of the moveable ring seat of the respective adjustable massaging assemblies, the sleeve is mounted to the drive rod and engaged with the connecting column of the moveable ring seat, on the slant projection of the ring seat of the fixed massaging assemblies is also provided a connecting column, the assembling sleeve is mounted to the drive rod and engaged with the connecting column of the fixed ring seat, on a periphery of the assembling pipe are provided a plurality of massaging rollers, another end of the assembling pipe extends into an annular step groove of the sleeve, at this another end of the assembling pipe is formed an annular receiving groove, the return element is disposed in the annular receiving groove of the assembling pipe and biased between a bottom of the annular receiving groove and an edge of the annular step groove of the sleeve.

17. The air-pressure massaging device having an automatic adjustment function as claimed in claim 16, wherein an annular flange is formed on the periphery of the assembling pipe of the massaging wheel assembly.

18. The air-pressure massaging device having an automatic adjustment function as claimed in claim 6, wherein each of the adjustable massaging assemblies comprises a housing, a movable ring seat, a connecting ring, a press ring, a ring and a limit ring, the housing of the adjustable massaging assembly is axially provided with a through hole through which the housing of the adjustable massaging assembly is moveably mounted onto the drive rod, the housings of the respective adjustable massaging assemblies are located correspondingly to each other and define a receiving space therebetween, the moveable ring seat is axially provided with a through hole through which the moveable ring seat is moveably mounted onto the drive rod, the ring of the adjustable massaging assembly is positioned on a slant projection of the moveable ring seat and is provided with a plurality of ear portions in each of which is received a ball, the connecting ring of the adjustable massaging assembly is locked with the press ring and the limit ring thereof and is positioned on the balls in the ear portions of the ring of the adjustable massaging assembly so that the connecting ring, the press ring and the limit ring are rotatably and slantwise arranged relative to the ring seat of the adjustable massaging assembly.

19. The air-pressure massaging device having an automatic adjustment function as claimed in claim 18, wherein each of the adjustable massaging assemblies is provided at its end facing the fixed massaging assemblies with a plurality of massaging projections.

20. The air-pressure massaging device having an automatic adjustment function as claimed in claim 18, wherein the ring seat of the respective adjustable massaging assemblies is provided at its end facing the fixed massaging assemblies with a slant surface.

21. The air-pressure massaging device having an automatic adjustment function as claimed in claim 18, wherein a plurality of cavities are annularly arranged on an end surface of the housing, an annular groove is correspondingly formed on end surface of the moveable ring seat, a plurality balls are received in the cavities and the annular groove, so that the moveable ring seat is able to rotate relative to the housing.

22. The air-pressure massaging device having an automatic adjustment function as claimed in claim 18, wherein a massaging wheel assembly is disposed between each pair of the fixed massaging assembly and the adjustable massaging assembly, and includes a sleeve, an assembling pipe and a return element, a connecting column is formed on the slant projection of the moveable ring seat of the respective adjustable massaging assemblies, the sleeve is mounted to the drive rod and engaged with the connecting column of the moveable ring seat, on the slant projection of the ring seat of the fixed massaging assemblies is also provided a connecting column, the assembling sleeve is mounted to the drive rod and engaged with the connecting column of the fixed ring seat, on a periphery of the assembling pipe are provided a plurality of massaging rollers, another end of the assembling pipe extends into an annular step groove of the sleeve, at this another end of the assembling pipe is formed an annular receiving groove, the return element is disposed in the annular receiving groove of the assembling pipe and biased between a bottom of the annular receiving groove and an edge of the annular step groove of the sleeve.

23. The air-pressure massaging device having an automatic adjustment function as claimed in claim 22, wherein an annular flange is formed on the periphery of the assembling pipe of the massaging wheel assembly.

24. The air-pressure massaging device having an automatic adjustment function as claimed in claim 1, wherein the airbag is inflated and deflated by an air pump.

25. The air-pressure massaging device having an automatic adjustment function as claimed in claim 24, wherein the air pump uses central processing unit to control inflation and deflation time of the airbag.

26. The air-pressure massaging device having an automatic adjustment function as claimed in claim 1, wherein the airbag is inflated and deflated manually by pressing a balloon.

* * * * *